United States Patent [19]

Marconi et al.

[11] Patent Number: 5,012,210

[45] Date of Patent: Apr. 30, 1991

[54] COMB-LINE BAND-PASS FILTERS IN THE MICROWAVE FIELD

[75] Inventors: Franco Marconi, Monza; Nicolo' De Stena, Cernusco S/Naviglio, both of Italy

[73] Assignee: Siemens Telecomunicazioni S.p.A., Milan, Italy

[21] Appl. No.: 446,022

[22] Filed: Dec. 5, 1989

[30] Foreign Application Priority Data

Dec. 21, 1988 [IT] Italy ..... 23033 A/88

[51] Int. Cl.[5] ..... H01P 1/205; H01P 1/207

[52] U.S. Cl. ..... 333/209; 333/203; 333/207; 333/235

[58] Field of Search ..... 333/202, 203, 206–212, 333/226, 227, 230, 231, 235, 248

[56] References Cited

U.S. PATENT DOCUMENTS

| | | | |
|---|---|---|---|
| 3,093,803 | 6/1963 | Schlicke et al. | 333/210 |
| 4,489,293 | 12/1984 | Fiedziuszko | 333/209 |
| 4,513,264 | 4/1985 | Dorey et al. | 333/209 X |
| 4,630,009 | 12/1986 | Tang | 333/212 X |
| 4,760,361 | 7/1988 | Kobayashi | 333/209 |

FOREIGN PATENT DOCUMENTS

| | | | |
|---|---|---|---|
| 0119501 | 9/1981 | Japan | 333/203 |

OTHER PUBLICATIONS

"Data for Partially Decoupled Round Rods Between Parallel Ground Planes", E. G. Crystal, IEEE Transactions on Microwave Theory and Techniques, May 1968; p. 311 ff.

*Primary Examiner*—Eugene R. LaRoche
*Assistant Examiner*—Seung Ham
*Attorney, Agent, or Firm*—Adel A. Ahmed

[57] ABSTRACT

A comb-line band-pass filter with circular cross section is made up of internal rods constituting the resonators of the filter and brought to resonance by the use of tuning screws and alternating with coupling screws. In the filter the rods are inserted in such a manner that each one is rotated in relation to the preceding one by an angle of $0° < \alpha < 90°$ while the coupling screws are placed at an intermediate angle. For equal electrical characteristics the length of the filter is also a function of the rotation angle of the rods.

7 Claims, 4 Drawing Sheets

COMB-LINE BAND-PASS FILTERS IN THE MICROWAVE FIELD

FIELD OF THE INVENTION

The present invention relates to the field of microwave filters and more specifically to a comb-line band-pass filter.

DESCRIPTION OF THE RELATED ART

A prevalent, if not exclusive, application of comb-line band-pass filters is in the accomplishment of microwave branching systems where the requirement for reducing the size and cost of said filters, especially when working in the L (from 1 to 2 GHz) frequency range and S (from 2 to 4 GHz) frequency range wherein the filter structures are developed mainly lengthwise, is growing.

It is known that a comb-line band-pass filter is made with a wave guide having a rectangular or circular cross section of a size such that the working frequencies are always less than the cutoff frequency. In the guide is inserted a series of parallel rods arranged in transverse planes and having a tength one-eighth the filter wavelength and alternating with coupling screws parallel to the rods. The rods constitute the resonators of the filter and their number depends on the frequency response characteristics of the filter.

Each rod is fixed to the guide at one end while at the opposite end a tuning screw is movable in close relationship thereto to create a concentrated capacitive load. The tuning screws regulate the tuning frequency while the coupling screws placed between the resonators regulate the coupling and hence the bandwidth i.e. for greater penetration there is a correspondingly wider bandwidth.

The magnetic component of the field generated near the rod brings about coupling with the following rod. Coupling depends on the distance between the rods and in particular increases as distance decreases.

Narrow bandwidths for the filter are obtained with strong decouplings between the rods with the invevitable drawback of lengthening of the structure.

A technical solution is known for excessive filter length, e.g. described in the article (or paper) of E.G. Cristal: "Data for partially decoupled round rods between parallel ground planes", MTT Microwave Technique and Technology, May 1968.

According to said known solution, to reduce the distance between the rods and hece the length of the filter, separating baffles are placed between the rods which bring about a decoupling effect that increases with their size. The baffles are introduced in slots made by cutting the filter widthwise generally at the positions of the coupling screws. Two possible main designs are achieved: (a) with complete baffles consisting of aligned pairs of baffles which leave uncovered more or less narrow bands in the middle of the guide, or (b) with half baffles, consisting of individual baffles rather than pairs, which leave uncovered in addition to the central bands the specular segments not covered by the other baffle.

Both of said designs have the drawback of increasing production time and costs because additional manufacturing operations are necessary to cut the guide, construct the baffles, introduce them, position them and weld them in place in the guide.

Assembly problems also increase considerably. Indeed the cutting operation considerably weakens the structure at the cuts, especially with complete baffles in which the cut is made through a large part of the cross section. This can lead to axial deformation and bending mainly during welding of the baffles because it involves heating of the guide.

SUMMARY OF THE INVENTION

Accordingly the object of the present invention is to obviate the above drawbacks and provide a comb-line band-pass filter with a round cross section in which the rods are inserted in such a manner that each one is rotated by an angle of $0° < \alpha > 90°$ in relation to the adjacent one. This also applies to the tuning screws while the coupling screws are placed at an intermediate angle in relation to the tuning screws or the rods.

Two variant designs are possible. A first variant calls for the rotation angle to remain unchanged as to modulus but change sign between one rod and the next so as to obtain two alternating rows of parallel rods. A second variant calls for the rotation angle to remain unchanged as to modulus and sign so as to obtain a rod pattern describing a helix on the guide surface.

The decoupling between the rods and hence also the length of the filter depend on the value of the rotation angle modulus.

To achieve these goals the object of the present invention is a comb-line band-pass filter as described in claim 1 and particularly in the two embodiment variants described in claims 2 and 3.

Additional goals and advantages of the present invention will be made clear by the following detailed description of an example of one of the variants thereof given only as a nonlimiting example with reference to the annexed drawings wherein:

DESCRIPTION OF THE PREFERRED EMBODIMENTS

Figure 1:
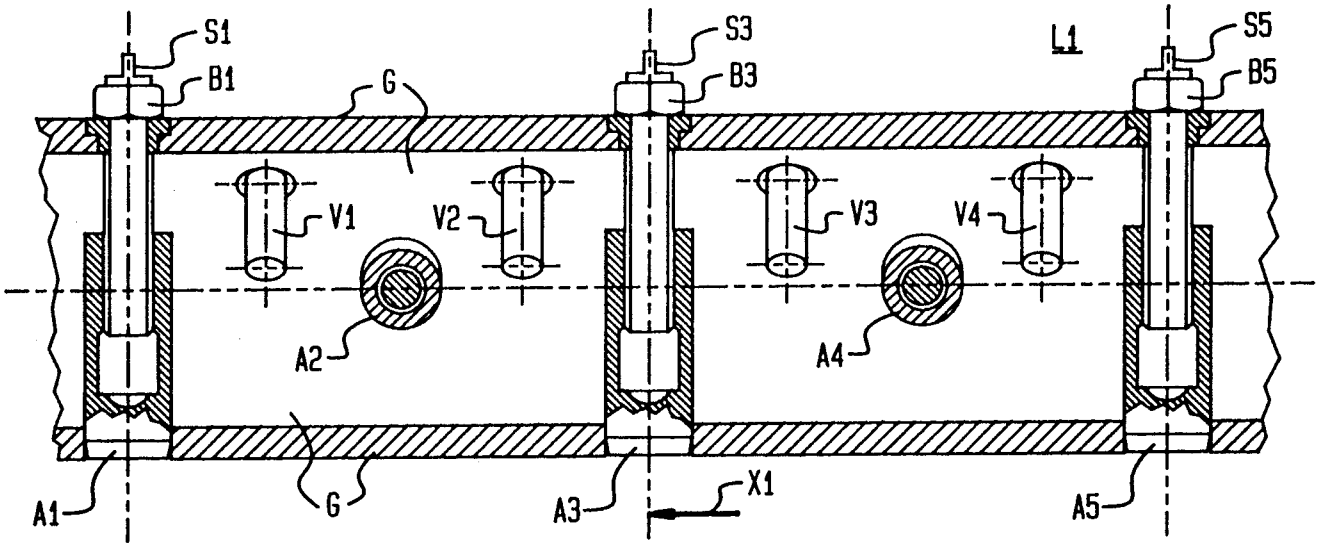
FIGS. 1 and 2 show longitudinal cross sections along planes L1 and L2 respectively of the comb-line filter which is the object of the present invention.
Figure 2:
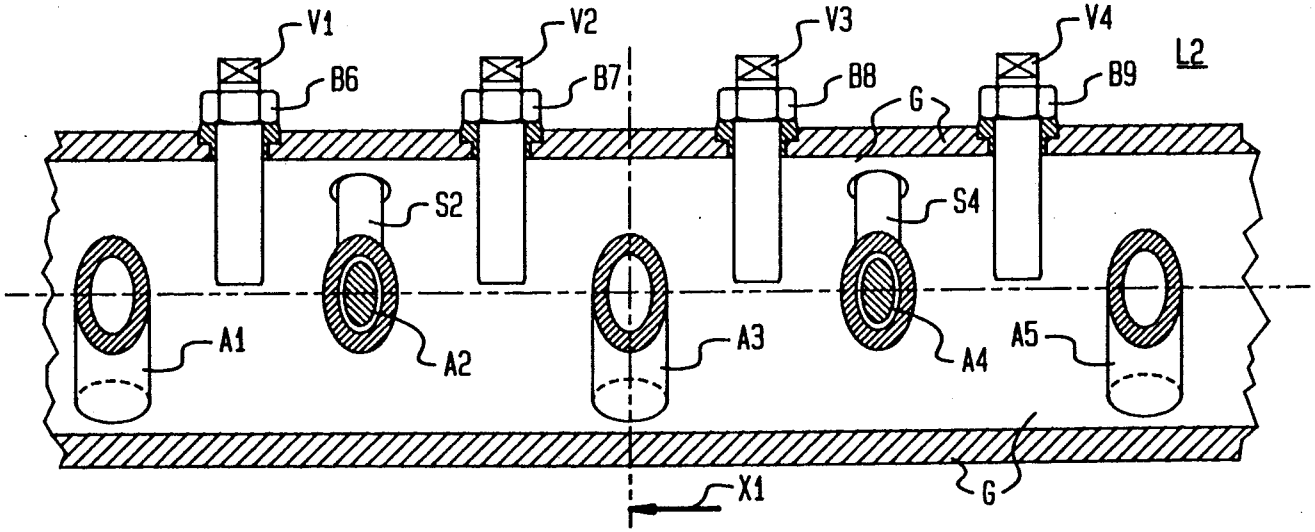

With reference to FIGS. 1 and 2 there is shown a longitudinal cross section along planes L1 and L2 respectively of a central portion of wave guide G which permits accomplishment of a comb-line band-pass filter. The two ends of the guide bearing the input and output connections of the filter are not shown because thery are of known type.

Figure 3:
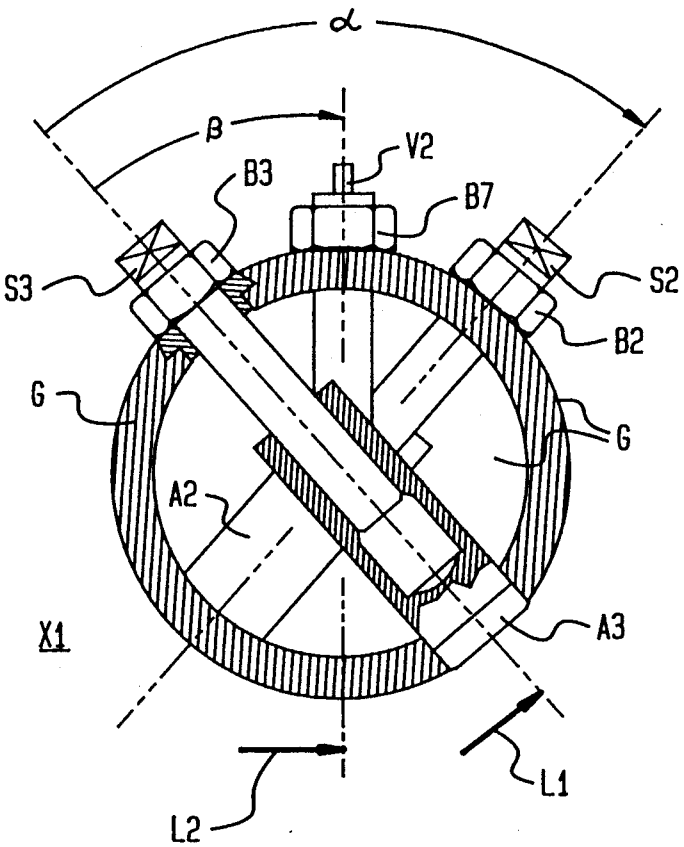
FIG. 3 shows a cross section along plane X1 thereof.

The guide G has a circular cross section X1 as shown in FIG. 3.

In FIGS. 1, 2 and 3, to which reference will be made jointly below, the same elements are indicated by the same symbols. In addition in FIGS. 1 and 2 is indicated view plane X1 which provides the cross section shown in FIG. 3, while FIG. 3 shows view planes L1 and L2 of the longitudinal cross sections shown in FIGS. 1 and 2.

A1, A2, A3, A4 and A5 indicate identical rods with a circular cross section. One end of said rod is closed to create a short circuit and is pivoted on the surface of the guide G while the other end, inside the guide, has a recess.

S1, S2, S3, S4 and S5 indicate tunign screws which screw in a known manner into the guide and are locked by nuts B1, B2, B3 B4 and B5 respectively at points diametrically opposite those at which the rods are pivoted. The tuning screws, one for each rod, are adjusted in such a manner as to draw near to and optionally penetrate the recess of the corresponging rod end without touching it.

The recess in the rods makes adjustment of the tuning screws less critical. Indeed if it were desired to obtain high capacitance without a recess the screws would have to be drawn too near to the rods with the risk of touching them. But with the screws able to penetrate the recess the increase in capacitance is obtained by increasing the screw surface area facing the recess.

V1, V2, V3 and V4 indicate coupling screws which, in the same manner as the tuning screws, screw in a known manner into the guide and are locked by nuts B6, B7, B8 and B9 respectively fixed in holes in the surface of the guide G.

FIG. 3 shows two successive rods, e.g. A3 and A2, and their tuning screws S3 and S2 respectively rotated to an angle of $0° < \alpha > 90°$ (e.g. $\alpha = 80°$) while the intermediate coupling screw, e.g. V2, is rotated to an angle of $\beta = \alpha/2$ in relation to the tuning screw S3.

The rod A1 is rotated in relation to A2 to an angle equal to $-\alpha$ as is A3 in relation to A4.

Thus each rod and hence each tuning screw is rotated in relation to the preceding one by an angle which remains unchanged in modulus and alternating in sign while the coupling screws are rotated by an angle equal to half of the angle between the two adjacent tuning screws.

Figure 4:
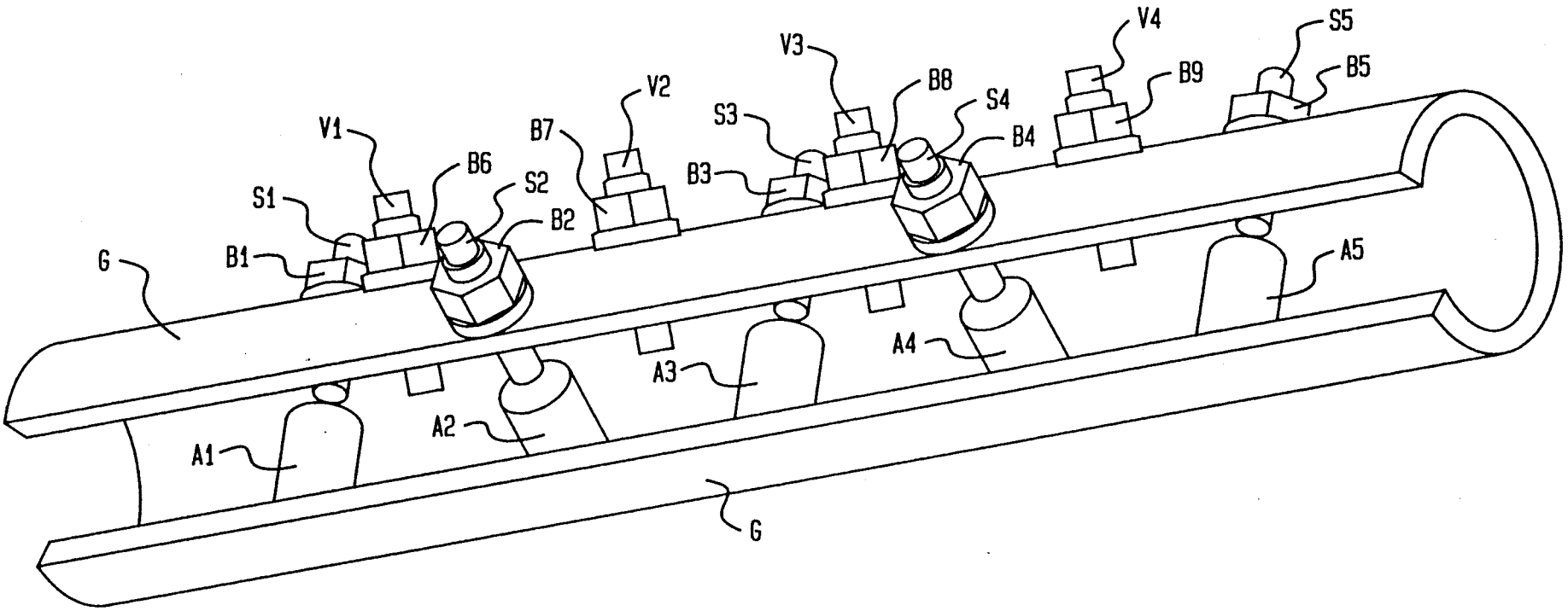
FIG. 4 shows a perspective view of a longitudinal cutaway thereof.

FIG. 4 shows another perspective view of a longitudinal cutaway of the comb-line filter in which the various component parts are indicated by the same symbols used in FIGS. 1, 2 and 3.

It can be seen in the above figures that the outlets of the tuning screws on the surface of the guide describe two parallel longitudinal rows (S1, S3, S5 and S2, S4) alternating with an intermediate longitudinal row of coupling screws (V1–V4).

The decoupling between the rods and hence the length of the filter depend on the value of the modulus of the rotation angle $\alpha$. This result is born out by laboratory tests performed on prototypes with different values of $\alpha$ compared with a filter prototype of known type having parallel rods but no baffles.

As a nonlimiting example it was sought to accomplish a filter operating in the frequency .ange around 1.5 GHz. For this purpose a guide G with a circular cross section and an internal diameter D of 26 mm and corresponding cutoff frequency of 6.8 GHz was chosen.

First the prototype of a filter having parallel rods but no baffles was made, and then tested by using different settings for different band widths B and finding for each value of B an average penetration of the coupling screws in the guide expressed as a percentage of the internal diameter D of said guide: $Ip = 100\ I/D$. I indicates the average length of the portions of the coupling screws inside the guide.

Then three filter prototypes having rods rotated relative to the adjacent rods by angles $\alpha$ of 50°, 80° and 85° respectively, were made and the same measurements were repeated, thus determining the new bandwitdths $b < B$.

Figure 5:
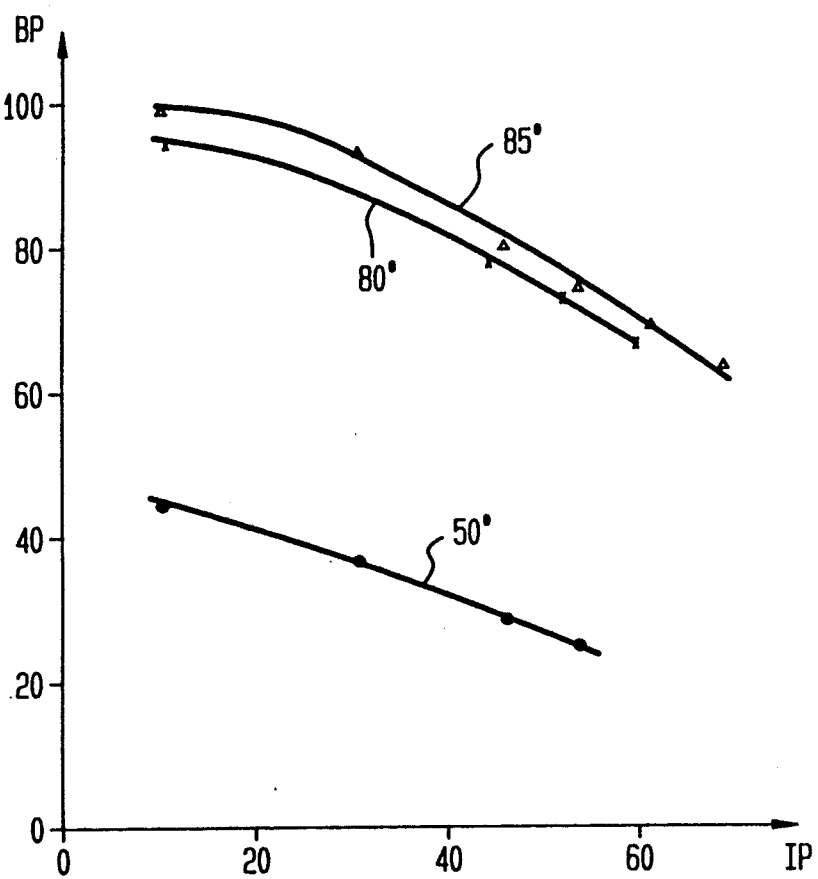

In this manner the graph shown in FIG. 5 was plotted to establish the relation between the bandwidth variation percent $Bp = 100(B-b)/B$ according to Ip assuming $\alpha$ as the parameter.

FIG. 5 shows the experimental points measured and the curves obtained by interpolation for the prototypes accomplished with the rotation angles $\alpha = 50°$, 80° and 85°.

Figure 6:
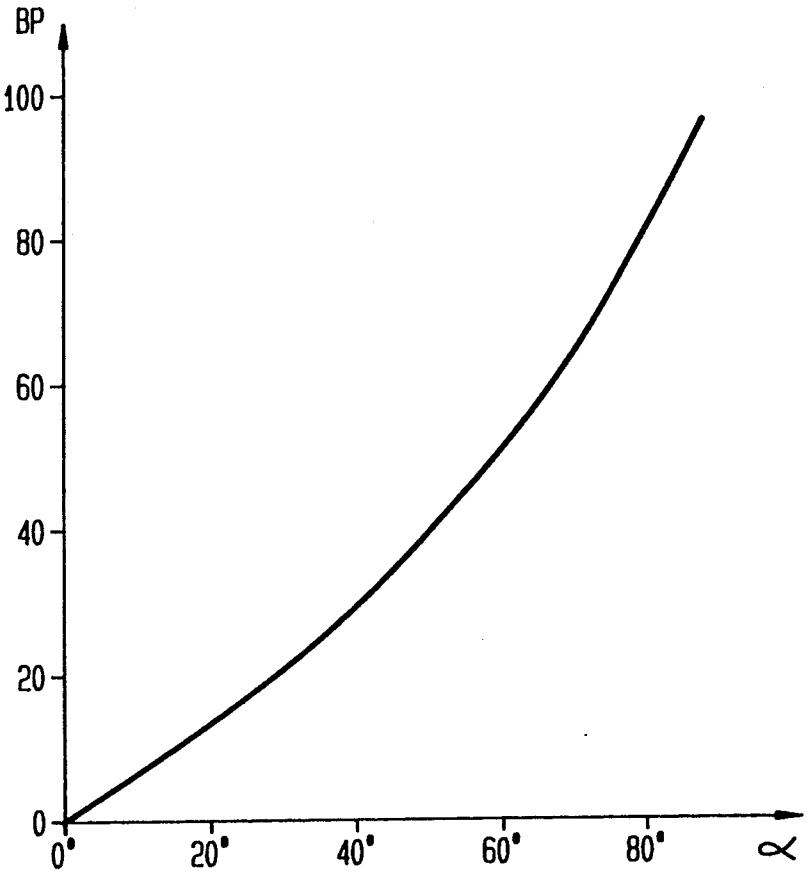
FIGS. 5 and 6 show graphs of some charactristics parameters of the filter.

From the curves shown in FIG. 5 is obtained the curve shown in FIG. 6 which, for an average penetration percent Ip as small as desired, establishes the relation between the bandwidth variation percent Bp and the angle of rotation $\alpha$.

For a predetermined value of $\alpha$ FIG. 6 supplies the parameter B/b which espresses the relation between bandwidth B of a parallel rod filter without baffles of length L and the bandwidth b of the filter having the same L but rods rotated to angle $\alpha$.

Therefore if $L' < L$ indicates the maximum allowable length of the filter to be sized, b' the required through bandwidth and B' the band of the corresponding parallel rod filter of length L', the following proportionality relation applies:

$$B:b = B':b' \quad (1)$$

From the above relation (1) it follows that if b' is the band actually required, the filter with rotated rods must be designed for a virtual bandwidth:

$$B' = b'(B/b) \quad (2)$$

In the above relation (2) B/b may be considered the corrective parameter to be used in sizing the central section of the filter while the design criteria of the input and output couplings remain unchanged.

In FIG. 6 it is seen that the parameter B/b increases as $\alpha$ increases so that the inclination between the rods can be increased appropriately until there is obtained an ever greater virtual bandwidth B' and correspondingly shorter filtering structures compatible with the maximum longitudinal dimensions required by the design specifications.

Analyzing the results, in the filter accomplished as explained above and for a through bandwidth B = 12 MHz and return loss = 25 dB, there is obtained a percentage shortening of length LC as compared with the known filter without baffles and with parallel rods of 10% for $\alpha = 50°$, 35% for $\alpha = 80°$ and 45% for $\alpha = 85°$.

The above observations also applying according to internal diameter of the guide provided the cutoff frequency of the guide is always at least two octaves above the working frequency. If this were not true there could occur undesired couplings between nonadjacent resonators because of the poor attenuation which the electromagnetic wave undergoes when it propagates inside the guide.

The above description makes clear the advantages of making comb-line band-pass filters in accordance with the present invention.

In particular there is obtained a strong structure easy to build and not excessively costly: To reduce its length it is thus unnecessary to introduce additional production operations to modify the guide as is the case when cutting to introduce baffles and weld them.

There are no particular assembly problems and the structure is not weakened.

The length of the filter is no longer a parameter linked exclusively to the electrical characteristics of the filter but becomes a magnitude which can be varied even on the basis of mechanical requirements, appropriately selecting the mutual inclination of the rods.

It is clear that numerous variants of the example of embodiment described are possible without thereby exceeding the scope of the innovative principles contained in the inventive idea.

In particular the angle of rotation $\alpha$ between the rods can be held constant in modulus and sign to obtain an arrangement of the rods and hence of the tuning and coupling screws in which the outlets on the surface of the guide describe a helix. The coupling screws are still always rotated to an angle equal to half that between the two adjacent tuning screws.

We claim:

1. A microwave band-pass filter comprising:

a wave guide having a longitudinal axis and a circular cross section;

a plurality of resonators spaced alternatingly with a plurality of coupling means in series along the longitudinal axis of the wave guide, said resonators and coupling means being arranged alternatingly in successive planes transverse to the longitudinal axis, wherein each of said resonators includes a rod and a tuning screw aligned along a common resonator axis which are coupled to and extend into the wave guide; and said resonators being arranged in said wave guide such that the resonator axis of each resonator is rotated in relation to that of a successive resonator by a constant modulus angle between 0 degrees and 90 degrees.

2. A microwave band-pass filter according to claim 1, wherein said constant modulus angle is of alternating sign as between successive resonators such that the resonators are arranged alternatingly in two parallel rows.

3. A microwave band-pass filter according to claim 1, wherein said constant modulus angle is constant in sign as between successive resonators such that the resonators are arranged in a helix along the wave guide.

4. A microwave band-pass filter according to claim 1, wherein said plurality of coupling means are a plurality of coupling screws, each of which is arranged between two successive resonators in the wave guide along a screw axis which is at an intermediate angle relative to the resonator axes of the two successive resonators.

5. A microwave band-pass filter according to claim 4, wherein said intermediate angle is one-half the modulus angle between the two successive resonators.

6. A microwave band-pass filter according to claim 1, wherein each rod of a resonator is fixed at one end to the wave guide and has a recess formed in its other end which extends into the wave guide, and the corresponding tuning screw has an end which can be moved near to and into the recess in the rod without touching it.

7. A microwave band-pass filter according to claim 1, wherein the resonators are spaced a given distance from each other, and the distance between resonators and the modulus angle of the resonator axes are determined according to a relationship wherein the distance decreases as the modulus angle increases according to the parameter B/b, in which B is a hypothetical bandwidth of the filter if the modulus angle were zero and the resonators were arranged in one row, and b is a through bandwidth of the filter for a given modulus angle.

* * * * *